US006690123B1

(12) United States Patent
Riddle et al.

(10) Patent No.: US 6,690,123 B1
(45) Date of Patent: Feb. 10, 2004

(54) ELECTRON GUN WITH RESISTOR AND CAPACITOR

(75) Inventors: George Herbert Needham Riddle, Princeton, NJ (US); Roger Casanova Alig, Princeton Junction, NJ (US); Aly Fathy, Langhorne, PA (US); Attiganal Narayanaswamy Sreeram, Edison, NJ (US); Barry Jay Thaler, Lawrenceville, NJ (US); Michael James Liberatore, Lawrenceville, NJ (US)

(73) Assignees: Sarnoff Corporation, Princeton, NJ (US); Samsung Display Devices, Co. LTD, Suwon (KR)

( * ) Notice: Subject to any disclaimer, the term of this patent is extended or adjusted under 35 U.S.C. 154(b) by 0 days.

(21) Appl. No.: 09/561,540

(22) Filed: Apr. 28, 2000

Related U.S. Application Data

(60) Provisional application No. 60/181,104, filed on Feb. 8, 2000.

(51) Int. Cl.[7] ..... G09G 1/04; H01J 29/50

(52) U.S. Cl. ..... 315/382; 313/414

(58) Field of Search ..... 315/3, 15, 5.34, 315/5.37, 382; 313/382, 414, 432, 446

(56) References Cited

U.S. PATENT DOCUMENTS 4,161,673 A 7/1979 Gregg et al.
4,317,065 A 2/1982 Hughes
4,614,894 A 9/1986 Izumida
4,945,284 A 7/1990 Shimoma et al.
5,396,156 A 3/1995 Iguchi et al.
5,424,619 A 6/1995 Okano et al.
5,449,983 A * 9/1995 Sugawara et al. ..... 315/382
5,519,290 A * 5/1996 Sugawara et al. ..... 315/382.1
5,539,285 A * 7/1996 Iguchi et al. ..... 315/382
5,661,363 A 8/1997 Iguchi et al.
5,670,841 A 9/1997 Muti et al.
6,479,926 B1 * 11/2002 Awano et al. ..... 313/414

* cited by examiner

*Primary Examiner*—Don Wong
*Assistant Examiner*—Minh D A
(74) *Attorney, Agent, or Firm*—William J. Burke

(57) ABSTRACT

An electron gun as for a cathode ray tube includes a plurality of electrodes biased at different potentials to electrostatically shape and focus the one or more electron beams produced thereby. A dynamic focus grid is driven by a substantial ac voltage signal at the horizontal line rate, which signal is undesirably coupled through parasitic capacitance to an intermediate grid located between the dynamic focus grid and the gun anode. A resistive biasing network includes a high value resistance to divide the anode potential to develop bias potential for the intermediate grid and a capacitance to ac couple the intermediate grid to ground potential. The resistance is formed in a single layer ceramic circuit and the capacitance is formed on the single layer ceramic circuit or on the tube neck. The ceramic circuit may be located in the tube neck on or with the electron gun.

33 Claims, 3 Drawing Sheets

ELECTRON GUN WITH RESISTOR AND CAPACITOR

This Application claims the benefit of U.S. Provisional Application Serial No. 60/181,104 filed Feb. 8, 2000.

The present invention relates to an electron guns, as for a cathode ray tube, and, in particular, to an electron gun with a resistor and a capacitor.

Performance of a cathode ray tube (CRT) depends upon the properties of the electron gun that is the source of electron beams therein, including aberrations within the electrostatic beam shaping and focusing lenses therein. Because such aberrations are related to the relatively high electrostatic potentials applied to the various grids of the electron gun, and in particular to the providing of a "smooth" potential gradient in the region between the focus grid and the anode. Conventionally, intermediate grids are provided between the focus grid and the anode and are biased at intermediate potentials to those of the focus grid and anode. Because these potentials are generally too high to be applied to the electron gun through pins penetrating the tube neck wherein the electron gun resides, another method is required.

Some conventional high-performance CRTs employ a high-voltage resistor connected between the anode and ground potential and tapped at a suitable point to provide a suitable bias potential for the grid intermediate the focus grid and anode. Typically, such resistors are formed of a ruthenium-oxide ink on an alumina ceramic substrate that is coated with a glaze to prevent arcing and damage therefrom. Very high resistance resistors are necessary to connect between anode potential and ground potential to drop the anode potential to an intermediate grid potential without excessive power dissipation. Typically, a resistance of about $10^9$ ohms is suited to drop the 25–30 kV anode potential while dissipating less than about one watt. Unfortunately, the close spacing of the grids, in particular the dynamic focus grid and intermediate grid of such high-performance CRT, produces a not insubstantial parasitic capacitance therebetween, typically a few picofarads, e.g., about 2–3 pF. The dynamic focus grid is not only biased at a relatively high dc bias potential, but is also modulated by an ac voltage of several hundred volts, e.g., ~500 volts, at the horizontal line scanning frequency, typically in the range of 30–100 kHz. As a result, that ac drive signal is undesirably coupled to the intermediate grid because the impedance of the parasitic capacitor is only about $10^6$ ohms at the horizontal scanning frequency, i.e. is relatively low as compared to the resistance of the about $10^9$ ohm resistor.

The result of this undesired coupling of the ac modulation signal also modulating the intermediate grid, and of loading from parasitic capacitance between other grids that prevents the dynamic focus grid from fully following the dynamic voltage, is that the dynamic focus grid ac modulation voltage signal must be increased substantially, by as much as 50%, to compensate for the loading of the resistively biased intermediate grid.

Accordingly, there is a need for an electron gun having a biasing arrangement that avoids or substantially reduces the undesirable effects of the parasitic capacitance between the dynamic focus grid and the intermediate grid.

To this end, the electron gun of the present invention comprises at least one cathode producing a beam of electrons, and a plurality of grids adapted to be biased at respective potentials for focusing the beam of electrons. The plurality of grids includes an anode grid adapted to be biased at an anode potential, a dynamic focus grid adapted to receive an ac signal, and an intermediate grid positioned intermediate the anode grid and the focus grid, wherein the focus grid and the intermediate grid are proximate and exhibit a value of parasitic capacitance. A resistance is coupled to the anode grid and to the intermediate grid for applying a portion of the anode potential thereto, and a capacitance coupled to the intermediate grid having a value greater than the value of parasitic capacitance.

According to another aspect of the invention, an electron lens as for an electron gun that produces a beam of electrons passing through the electron lens, comprises a plurality of electrodes through which the electron beam passes, at least one of the electrodes being a focus electrode and at least one other of the electrodes being a dynamic focus electrode. A source of a dynamic focusing signal is coupled to the one other of the electrodes for applying dynamic focusing signal thereto and a further electrode is proximate the dynamic focus electrode. A resistance having a first end adapted to be coupled to a source of bias potential and a second end adapted to be connected to a point of reference potential includes a tap intermediate the first and second ends thereof, and the tap being connected to said further electrode. A capacitance has a first electrode coupled to the further electrode and a second electrode adapted to be coupled to the point of reference potential.

BRIEF DESCRIPTION OF THE DRAWING

The detailed description of the preferred embodiments of the present invention will be more easily and better understood when read in conjunction with the FIGURES of the Drawing which include.

Figure 1:
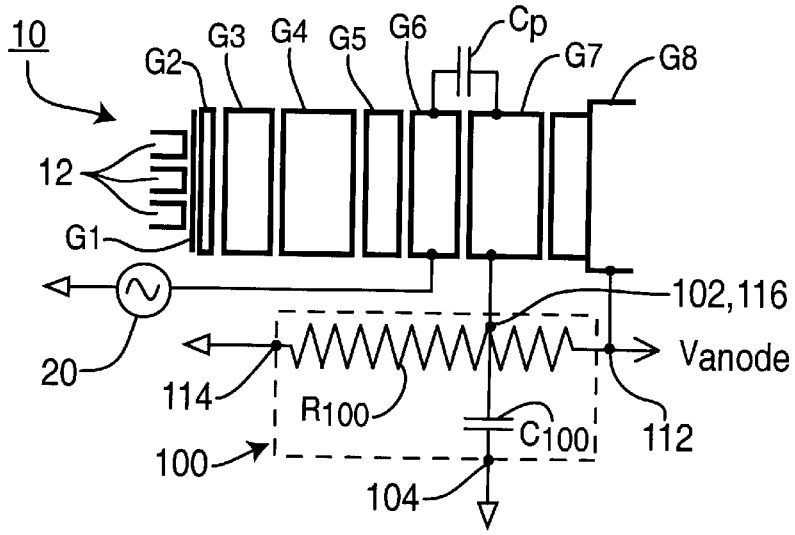
FIG. 1 is a schematic diagram of an exemplary electron gun arrangement in accordance with the invention.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. Similarly, similar elements or features may be designated by like alphanumeric designations in different figures of the Drawing and with similar nomenclature in the specification.

DESCRIPTION OF THE PREFERRED EMBODIMENT

FIG. 1 is a side view schematic diagram of an exemplary electron gun arrangement 10 in accordance with the invention. Electron gun 10 is an in-line three-beam electron gun as for use in a three beam color CRT. Three beams of electrons are produced from cathodes or electron sources 12 at the left side of FIG. 1 and flow rightward through grids G1–G8 wherein they are appropriately shaped, focused and accelerated to exit gun 10 at the anode G8 thereof. Each of grids G1–G8, which may be referred to as either electrodes or grids, has three in-line openings or apertures through which the three beams of electrons produced by the three in-line cathodes 12 pass. Grids G3 to G8 form the main electron lens of electron gun 10, with grids G3–G5 being considered a pre-focus electron lens and grids G5–G8 being considered a focus lens.

Anode G8 is biased to a high positive anode bias potential $V_{ANODE}$ of about +25 to +30 kV that is applied in conventional manner through a high voltage feedthrough conductor or "button" penetrating the glass bulb of the CRT. Grid G1 is a flat plate biased at ground potential. Grid G2 is a screen grid and is biased at a low positive potential, typically about +500 v. Grids G3 and G5 are biased at a positive potential, typically about +8 to +10 kV, that is intermediate the dc bias potential of the focus grid G6 and ground potential, to affect beam focus. Grid G4 is biased at a low positive potential, typically close to that at which grid G2 is biased, e.g., about +500 v. Grid G6 is a dynamic focus grid that is modulated by an ac modulation signal of about 500 volts ac from signal source 20 at the horizontal line scanning frequency and is biased at a focus grid potential, typically about +8 to +10 kV, that is intermediate the bias potential on anode G8 and ground potential. G7 is an intermediate grid provided between dynamic focus grid G6 and anode G8 to control the potential gradient therebetween by being biased to a potential intermediate the bias potentials of dynamic focus grid G6 and anode G8, typically at a potential between +10 kV and +30 kV, but not higher than the anode G8 bias potential $V_{ANODE}$.

Bias potential for intermediate grid G7 is provided by circuit 100. Circuit 100 includes a high resistance resistor $R_{100}$ between resistor terminals 112, 114, connected respectively to the high positive anode bias potential $V_{ANODE}$ at anode G8 and to ground potential, and a tap terminal 116 at which the desired potential, which is intermediate the anode bias potential $V_{ANODE}$ and ground potential, is produced. Owing to the proximity of grids G6 and G7 a parasitic capacitance (represented by capacitor $C_P$ shown in phantom) appears therebetween. As explained above, ac modulation signal from source 20 is undesirably coupled to intermediate grid G7 by parasitic capacitor $C_P$. To reduce such undesired coupling, circuit 100 also includes capacitor $C_{100}$ having a capacitance that is sufficiently larger than the capacitance of parasitic capacitor $C_P$. Capacitor $C_{100}$ is connected at its terminal 102 to tap terminal 116 of resistor $R_{100}$ and at its terminal 104 to ground potential to, in effect, ac couple intermediate grid G7 to ground through an impedance that is substantially lower at the horizontal line scanning frequency than is the impedance of resistor $R_{100}$ and of the parasitic capacitance $C_P$.

Typically, capacitor $C_{100}$ has a capacitance of about 10–20 pF which is about ten or more times larger than the about 1–2 pF capacitance of parasitic capacitor $C_P$, and resistor $R_{100}$ has a resistance of about $10^9$ ohms. Preferably, circuit 100 is a glass or glass-like component that is or can be mounted on or near electron gun 10 within the neck of a CRT.

Thus, circuit 100 desirably provides a low impedance ac circuit to ground, thereby substantially reducing or eliminating the undesired coupling of the ac modulation signal through parasitic capacitance $C_P$ while maintaining the desirably high dc resistance of resistor $R_{100}$, thereby maintaining the power dissipated therein to less than about one watt.

Figure 2:
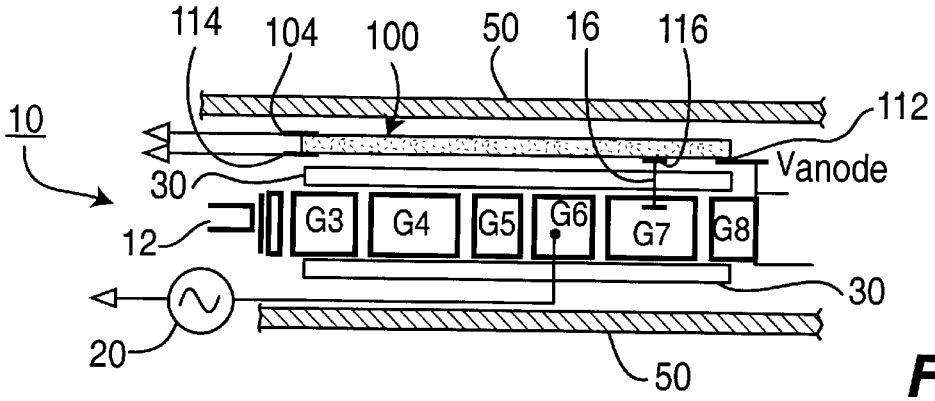
FIG. 2 is a partially cross-sectional side view schematic diagram of an exemplary electron gun structure arrangement in accordance with the invention situate in a tube neck.

FIG. 2 is a partially cross-sectional side view schematic diagram of an exemplary electron gun 10 structure in accordance with the invention situated in the neck 50 of a cathode ray tube. Electrons produced by cathode electron source 12 move rightward through respective apertures in grids G1–G8 to exit the electron gun 10 at anode G8 at the right end thereof. Cathodes 12 and grids G1–G8 are supported by gun structure 30 surrounding, at least partially, grids G–G8. Only one cathode 12 is visible in this side view, the other cathodes being in line behind the one visible. As above, dynamic focus grid G6 is adjacent and proximate intermediate grid G7.

In the orientation in which electron gun 10 is shown in FIG. 2, its thinner dimension is shown (i.e. thickness determined by one cathode rather than by three cathodes as in FIG. 1). In the space between gun 10 and tube neck wall 50 is sufficient room to mount resistor-capacitor network 100 which includes resistor $R_{100}$ which is preferably on the surface of a layer of fired ceramic of network 100, and capacitor $C_{100}$ which is formed on the layer of fired ceramic or is mounted to a surface of network 100 on which resistor $R_{100}$ is formed or an opposing surface. The dc potential at tap 116 is derived from the anode potential $V_{ANODE}$ with respect to a dc reference point (dc ground) to which resistor terminal 114 connects, is filtered by capacitor $C_{100}$ of which terminal 104 is connected to ac ground, and is connected to grid G7 by a wire 16 or by a snubber, spring clip or other suitable conductor. Resistor $R_{100}$ and tap or taps 116 thereof are preferably on the side of network 100 facing away from gun 10. Network 100 may be covered by glaze of an insulating glass or ceramic for mechanical protection and for resistance to electrical arcing. The ceramic substrate of network 100 may be of alumina or other suitable ceramic or other material that can withstand the high temperature at which the tube in which network 100 is utilized is processed and the high voltage and vacuum at which electron gun 10 is operated.

For conductors, including conductors forming electrodes, contacts or other parts of resistors and capacitors, metal-filled thick-film inks are deposited onto one or both broad surfaces of the ceramic layer, preferably by screen printing. Available suitable resistive materials for printed or deposited conductors and contacts have a resistivity of about 50 Ω/square or greater. A resistive pattern is screen printed of a high resistivity ink onto the ceramic dielectric substrate. Suitable high resistivity thick-film inks employ high resistivity materials, such as ruthenium oxide, that is a conductive phase dispersed in an insulating glass frit with suitable organic resins and solvents to permit screen printing. Available resistive materials suitable for forming resistors have a resistivity of up to about 100,000 Ω/square to 1,000,000 Ω/square.

Figure 3:
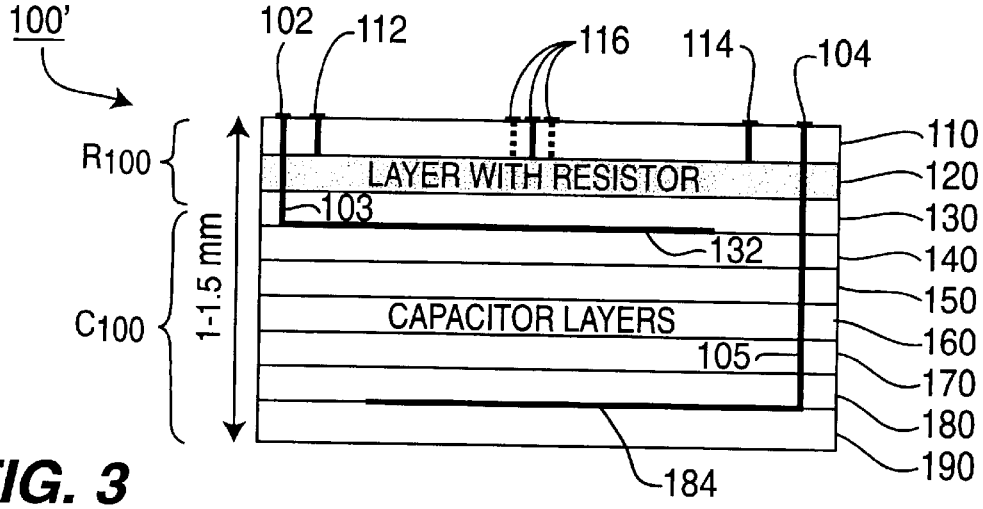
FIG. 3 is a side elevation view of an exemplary resistor capacitor arrangement in accordance with the invention and useful in the electron gun of "FIGS. 1 and 2.

FIG. 3 is a side elevation view of an exemplary embodiment of a resistor capacitor arrangement 100 in accordance with the invention and useful in the electron gun 10 of FIGS. 1 and 2. Circuit component 100' is a layered ceramic circuit structure 100 in which are fabricated resistor $R_{100}$ and capacitor $C_{100}$ in various layers. Therein, resistor $R_{100}$ may comprise a layer of high resistivity material contained within a ceramic layered structure 100' or a thick-film resistive material printed on a ceramic layer of such structure. Similarly, capacitor $C_{100}$ may comprise thick-film conductive plates (electrodes) printed on opposite sides of plural ceramic layers (where plural ceramic layers are needed to provide support the voltage applied across the capacitor) or may be on sides of plural ceramic layers (where each layer can withstand the voltage to be applied to the capacitor), which layers are laminated together as to form a single component.

Exemplary circuit structure 100' includes ceramic layers 110, 120 in which is formed resistor $R_{100}$ and ceramic dielectric layers 130, 140, 150, 160, 170, 180, 190, in which is formed capacitor $C_{100}$. Structure 100' is formed of layers of low temperature co-fired ceramic (LTCC) materials on which are printed or otherwise deposited thick-film conductive ink patterns forming the various contacts, electrodes, conductive vias and the like of circuit structure 100'. It is noted that such LTCC materials are compatible with both the high voltages of the CRT bias potentials, e.g., up to about 30 kV, and are, by nature, compatible with CRT processing, including bake-out at 450° C. or higher, and with the vacuum environment interior to a CRT.

Capacitor $C_{100}$ includes a first plate comprising a conductive electrode 132 on the underside of ceramic dielectric layer 130 (or on the top side of ceramic layer 140), which electrode is connected to capacitor terminal 102 by conductive connection or via 103 that passes through ceramic layers 110–130. The second plate of capacitor $C_{100}$ comprises conductive electrode 184 on the underside of ceramic dielectric layers 180 (or on the topside of layer 190), which electrode is connected to capacitor terminal 104 by conductive connection or via 105 that passes through ceramic layers 110–180. LTCC ceramic circuit structure 100' is fabricated from separate layers of glass-ceramic tape onto and into which are printed both conductive interconnections and vias, high-resistivity resistors, and other components, while the ceramic tape is in its "green" or unfired state.

For conductors, including conductors forming electrodes or other parts of resistors and capacitors, metal-filled thick-film inks are deposited onto one or both broad surfaces of the green ceramic tape, preferably by screen printing. For conductive vias (interconnections) through and between tape layers, fine holes are punched in the green ceramic layers and are filled with a metal-frit filled paste. Available suitable resistive materials for printed or deposited conductors and vias have a resistivity of about 30 mΩ/square or less. Ceramic dielectric materials to compatible with LTCC having a dielectric constant in the range of 6 to 6000 are available, which materials allow embedded capacitors to be formed having capacitance values of a few picofarads to several hundred nanofarads. Capacitor electrodes are printed on dielectric ceramic tape layers having a thickness sufficient to withstand the expected applied voltage. For example, a pair of 200 $mm^2$ capacitor plates separated by a 1.0 mm thickness of ceramic dielectric having a dielectric constant of six has a capacitance of about 10 pF, and can withstand an operating voltage of about 20–30 kV.

Plural ceramic layers prepared in the foregoing manner are aligned and stacked one on the other, are laminated together under pressure, and are then fired at a high temperature, typically about 800° C. Preferably, a substantial number of circuit structures are formed contemporaneously on relatively large, e.g., 100 mm by 100 mm, sheets of such green ceramic tape, and are then scribed and broken apart into individual structures 100' after being co-fired. Suitable LTCC materials are described, for example, in U.S. Pat. No. 5,581,876 entitled "Method Of Adhering Green Tape To A Substrate With A Bonding Glass."

Connections between, for example, terminal 114 of resistor $R_{100}$ and terminal 104 of capacitor $C_{100}$, and between tap 116 of resistor $R_{100}$ and terminal 102 of capacitor $C_{100}$ may be made internally to circuit structure 100' or externally thereto by conductors formed of thick-film conductive ink deposited on one of the layers 110–130 thereof, or may be made externally by welded wires or other suitable connection. The conductive thick-film ink utilized for resistor terminals 112, 114, 116 and for capacitor terminals 102, 104 includes metal fillers compatible with welding of electrical leads thereto, such as leads of kovar, nickel alloy or other weldable metal.

Figure 4A:
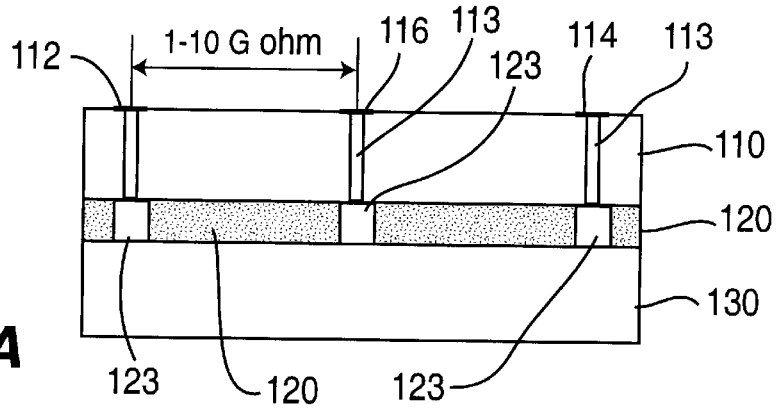
FIGS. 4A and 4B are side elevation views of a portion of the resistor capacitor arrangement of FIG. 3 illustrating alternative arrangements thereof.

FIG. 4A is a side elevation view of a portion of the resistor capacitor structure 100' of FIG. 3 in which layer 120 comprises a layer of low-conductivity doped ceramic tape material that is "buried" within ceramic structure 100', i.e. is between ceramic dielectric layers 110 and 130 thereof. Such material employs dopants, such as semiconductive oxides, e.g., ferrous oxide ($Fe_2O_3$), tin oxide ($SnO_2$), and cobalt oxide ($CoO_2$) added to the bulk ceramic dielectric material, which has a bulk resistivity after firing of greater than $10^{12}$ Ω-cm, at suitable concentrations for percolative conduction, thereby to obtain a resistive ceramic material having a bulk resistivity of about $10^8$ Ωcm. Resistance values in the range of about 1–10 gigohms are obtained by selecting the dimensions of the resistance layer given the bulk resistivity thereof. For example, a resistor that is about 2.5 cm (about 1 inch) long and about 0.5 cm (0.2 inch) wide in a 100–150 μm thick LTCC tape layer having a bulk resistivity $\rho=10^7$ Ω-cm would have a resistance in the range of about 3.3 to 5 GΩ, which value could be adjusted by changing the geometry or by including trimming geometries to facilitate mechanical trimming.

Conductive electrodes or contacts 123 are formed of conductive thick-film ink printed or other wise deposited on the resistive layer 120 or in fine holes punched therein in like manner to the making of conductive vias. Electrodes or contacts 123 of resistive layer 120 are connected to resistor terminals 112, 114 and tap terminal 116 by respective conductive vias 113 through ceramic dielectric layer 110.

Figure 4B:
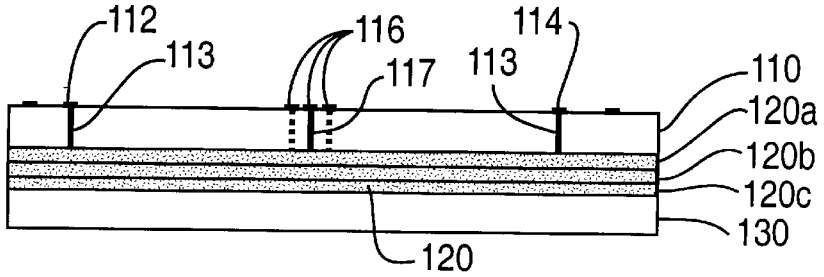
Figure 5:
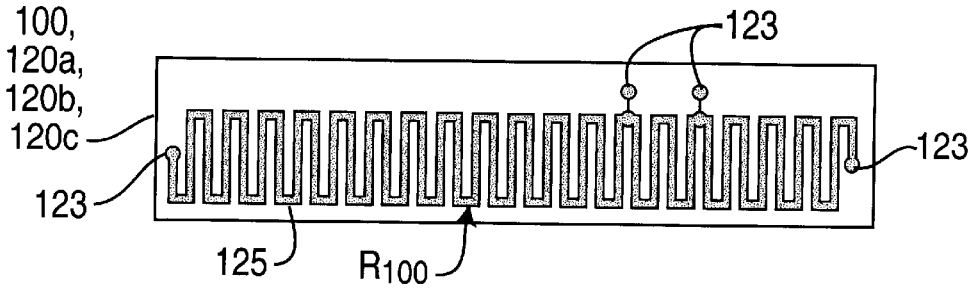
FIG. 5 is a plan view of an exemplary resistor capacitor arrangement useful in the embodiments of FIG. 3 and FIGS. 4A and 4B.

FIG. 4B is a side elevation view of a portion of the resistor capacitor structure 100' of FIG. 3 in which layer 120 comprises one or more layers, e.g., three layers **120*a*, 120*b*, 120*c*, each comprising a ceramic dielectric layer having a serpentine resistive pattern 125 printed thereon to form resistor $R_{100}$, as shown in FIG. 5, for example. Conductive electrodes or contacts 123 at each end of serpentine resistive pattern 125 connect through conductive vias to the adjacent layers 120*a*, 120*b*, 120*c*, and through ceramic dielectric layer 110 to resistor and resistor tap terminals 112, 114, 116. Serpentine resistive pattern 125 is preferably screen printed of a high resistivity ink onto one or more layers of green ceramic dielectric tape 120*a*, 120*b*, 120*c*** prior to their being laminated and fired.

FIG. 5 also illustrates a serpentine resistor pattern on a single ceramic layer as described above in relation to FIG. 2, for example. Serpentine resistive pattern 125 is preferably screen printed of a high resistivity ink onto a fired ceramic dielectric layer and contacts 123 are printed of a conductive thick film ink, both of which are then fired to fire the resistive ink and the conductive ink to the fired ceramic.

In either embodiment, suitable high resistivity thick-film inks employ high resistivity materials, such as ruthenium oxide, that is a conductive phase dispersed in an insulating glass frit with suitable organic resins and solvents to permit screen printing. Available resistive materials suitable for forming resistors have a resistivity of up to about 100,000 Ω/square to 1,000,000 Ω/square. A serpentine pattern 125 of about 0.76 mm (about 0.030 inch) wide lines on about a 1 mm (about 0.04 inch) pitch printed with an ink of 1.5 M Ω/square resistivity would require about 667 squares on one or more ceramic dielectric layers to provide a 1 GΩ/resistance.

Figure 6:
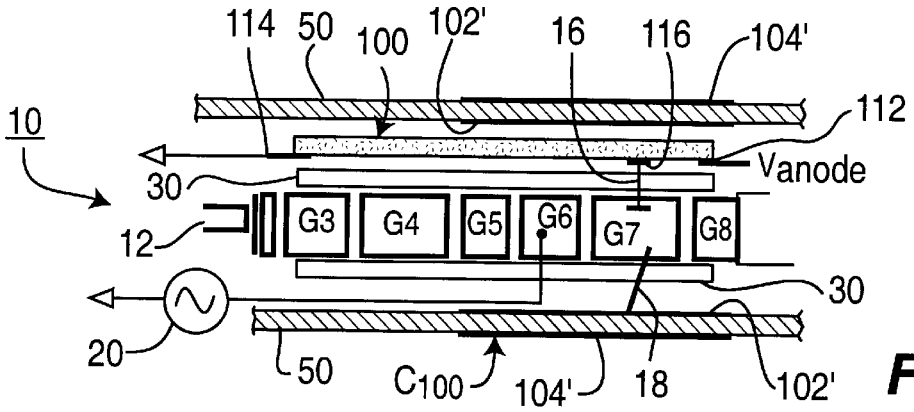
FIG. 6 is a partially cross-sectional side view schematic diagram of an exemplary electron gun structure arrangement in accordance with the invention alternatively situated in a tube neck.

FIG. 6 is a partially cross-sectional side view schematic diagram of an exemplary electron gun 10 structure in accordance with the invention alternately situate in the neck 50 of a cathode ray tube. Electron gun 10 and supports 30, and the positioning thereof are as described above in relation to FIG. 2. In the space between gun 10 and tube neck wall 50 is sufficient room to mount resistor-capacitor network 100 which in this arrangement need only include resistor $R_{100}$ which is preferably on the side of network 100 that faces electron gun 10, but could also optionally include a capacitor $C_{100}$. As before, the dc potential at tap 116 is derived from the anode potential $V_{ANODE}$ with respect to a dc ground to which resistor terminal 114 connects, and is filtered by capacitor $C_{100}$.

In the embodiment of FIG. 6, however, capacitor $C_{100'}$ is formed on the glass wall of the neck 50 of the CRT by two capacitor plates 102', 104' on the inner and outer surfaces, respectively, of the glass wall of tube neck 50, for example, deposits of a thin-film or other conductive material deposited thereon, such as by vacuum evaporation, spraying, spin casting or other suitable method. Plate 102' is formed on the inner surface of the glass wall of tube neck 50 and connects to tap 116 of resistor $R_{100}$ and to grid G7 through a snubber or spring clip 18, or other suitable conductor. Plate 104' is similarly formed on the outer surface of the glass wall of tube neck 50, and is connected to an ac ground. The glass wall 50 of the tube neck between capacitor plates 102', 104' serves as the dielectric between the plates 102', 104' of capacitor $C_{100'}$. Plates 102', 104' could be cylindrical, rectangular or of other convenient shape and of such area as necessary to obtain the desired capacitance given the thickness and dielectric constant of the glass of the tube neck 50.

Figure 7:
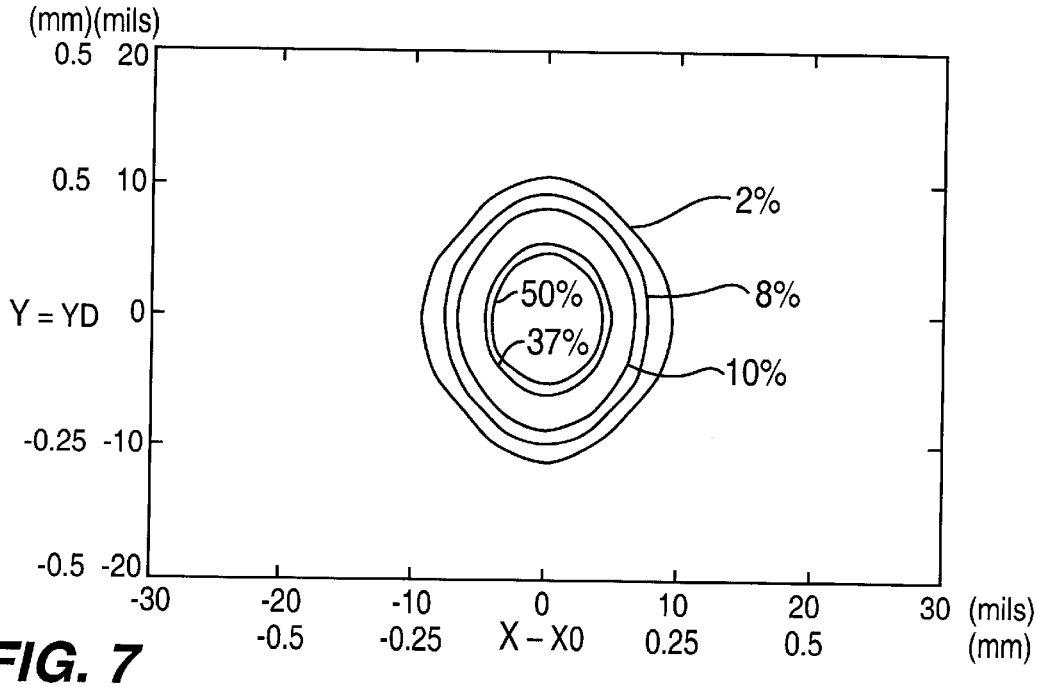
FIG. 7 is a graphical representation of an exemplary electron beam spot produced by an electron gun according to the invention.

FIG. 7 is a graphical representation of current density contours for an exemplary electron beam spot produced by an electron gun 10 according to the invention. Contours at 2%, 5%, 10%, 37% and 50% (in order, from the outermost to the innermost contour) of an exemplary 300 μampere peak current density electron beam are plotted in the X-Y plane, i.e. a plane perpendicular to the center line of the CRT which is coaxial with the central axis of electron gun 10. At the 5% of peak current density contour, the width of the beam (X-axis dimension) is about 0.39 mm and the height of the beam (Y-axis dimension) is about 0.46 mm, which dimensions are also the desired size of the shadow mask slit through which such beam would pass in a shadow mask color CRT.

Figure 8:
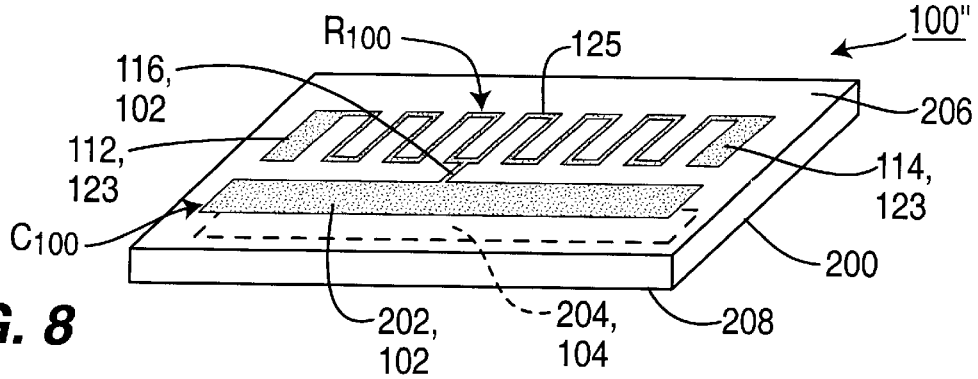
FIG. 8 is an isometric view of an exemplary resistor capacitor arrangement in accordance with the invention.

FIG. 8 is an isometric view of an exemplary resistor capacitor circuit arrangement 100" in accordance with the invention in which resistor $R_{100}$ and capacitor $C_{100}$ are formed on a single layer ceramic substrate 200. Resistor $R_{100}$ is printed in a serpentine pattern 125 on one surface 206 of ceramic substrate 200 using a high resistivity ink with terminals, contacts 123 at the ends thereof providing terminals 112, 114, and with a tap contact 116 at an intermediate point along serpentine resistance 125. Capacitor $C_{100}$ comprises a first conductive capacitor plate 202 formed on the same surface 206 of substrate 200 as is serpentine resistance 125 and a second conductive plate 204 (shown in phantom) on the opposing surface 208 of substrate 200 directly opposite the first plate 202. Each of capacitor plates 202, 204 is printed in the same manner of a conventional conductive ink suitable for a ceramic substrate 200. Tap contact 116 connects to capacitor plate 202 at contact 102, all of the foregoing forming a circuit as shown and described, for example, in relation to FIG. 1.

Ceramic substrate 200 with the conductive and resistive ink patterns thereon is then fired as appropriate to the particular ink composition to permanently form the resistor capacitor circuit with the inks fused to substrate 200. The thickness of ceramic sheet 200 is sufficient to withstand the high dc potential applied to capacitor $C_{100}$, i.e. the dc bias potential applied to focus grid G7, and the area of capacitor plates 202, 204 is sufficient to provide, given the dielectric constant of the ceramic material of substrate 200, the desired capacitance of capacitor $C_{100}$. For example, a pair of 100 $mm^2$ capacitor plates separated by a 1.00 mm thickness of alumina or similar ceramic having a dielectric constant of 10 produces a capacitance of about 10 pF that can withstand an applied voltage up to about 20 kV. Network 100" may be glazed for mechanical protection and to resist electrical arcing. The dielectric substrate may be ceramic or glass or other suitable material.

While the present invention has been described in terms of the foregoing exemplary embodiments, variations within the scope and spirit of the present invention as defined by the claims following will be apparent to those skilled in the art. For example, resistor $R_{100}$ may have plural taps that are connected to various ones of the grids of electron gun 10, at least one of which is also as coupled to ground potential by a capacitor $C_{100}$. Similarly, circuit structure 100 may include plural capacitors like capacitor $C_{100}$ where it is desired to ac couple plural grids to ground potential.

Figure 9:
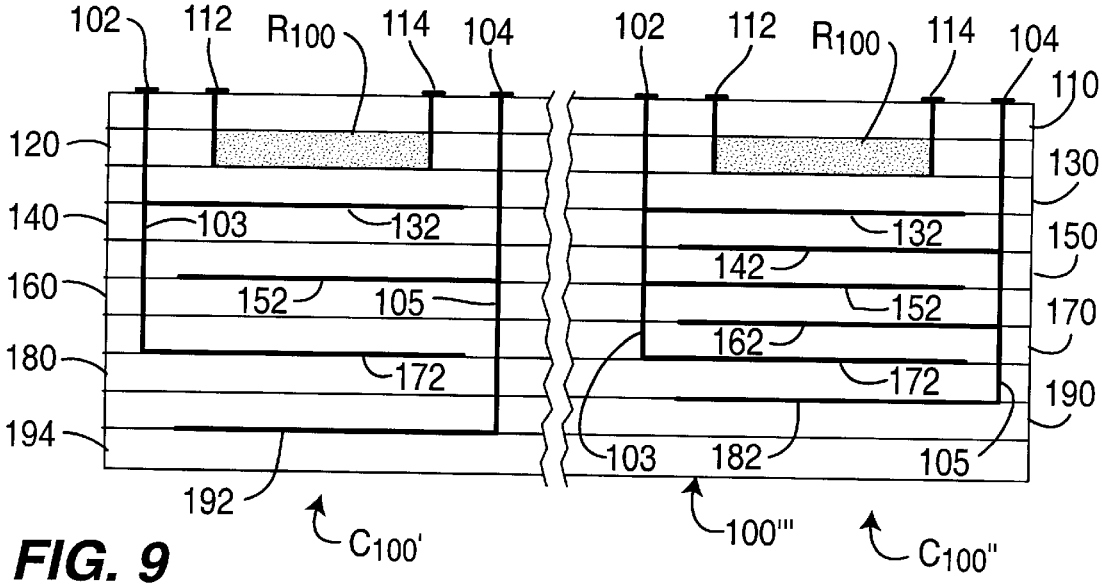
FIG. 9 is a side elevation view of an exemplary alternative resistor capacitor arrangement in accordance with the invention and useful in the electron gun of "FIGS. 1, 2 and 3.

In addition, alternative circuit structures may be utilized in connection with the invention. In FIG. 9, for example, circuit network 100'" is illustrated that is a plural-layer ceramic structure similar to circuit structure 100 of FIG. 3 above, except in the arrangement of the plates of the capacitors formed therein. Network 100'" includes an exemplary capacitor $C_{100'}$ having two plates, each of which comprises two electrodes 132-172 and 152-192 that have two layers of ceramic dielectric between adjacent capacitor electrodes for providing a capacitor having the ability to withstand a particular applied voltage. Network 100'" also includes an exemplary capacitor $C_{100''}$ having two plates, each of which comprises three electrodes 132-152-172 and 142-162-182 that have one layer of ceramic dielectric between adjacent capacitor electrodes for providing a capacitor having the ability to withstand a particular applied voltage. If, for example, the ceramic layers 130–190 are of the same material and thickness as those of the structure 100 of FIG. 3, then capacitor $C_{100}$ of FIG. 3 will withstand a greater applied voltage than will capacitor $C_{100'}$ of FIG. 9, and capacitor $C_{100'}$ will withstand a greater applied voltage than will capacitor $C_{100''}$ of FIG. 9.

What is claimed is:

1. An electron gun comprising:

at least one cathode producing a beam of electrons;

a plurality of grids adapted to be biased at respective potentials for focusing the beam of electrons, said plurality of grids including:

an anode grid adapted to be biased at an anode potential;

a dynamic focus grid adapted to receive an ac signal; and an intermediate grid positioned intermediate said anode grid and said focus grid, wherein said focus grid and said intermediate grid are proximate and exhibit a value of parasitic capacitance therebetween;

a resistance coupled to said anode grid and to said intermediate grid for applying a portion of the anode potential thereto; and a capacitance coupled to said intermediate grid having a value greater than the value of parasitic capacitance.

2. The electron gun of claim 1 wherein said resistance comprises a single layer of dielectric ceramic on which said resistance is formed.

3. The electron gun of claim 2 wherein said single layer of dielectric ceramic circuit is mounted to said electron gun.

4. The electron gun of claim 1 further comprising a tube neck of a dielectric material in which said cathode and said plurality of grids reside, wherein said capacitance comprises a first plate on an exterior surface of said tube neck and a second plate on an interior surface of said tube neck, wherein said second plate is coupled to said intermediate grid.

5. The electron gun of claim 1 wherein said resistance and said capacitance comprise a ceramic circuit having a plurality of layers of dielectric ceramic, at least one of said layers forming said resistance and at least one other of said layers forming said capacitance.

6. The electron gun of claim 5 wherein said one of said layers forming said resistance comprises a low conductivity ceramic layer having a conductivity lower than the conductivity of an adjacent dielectric ceramic layer.

7. The electron gun of claim 6 wherein said low conductivity ceramic layer includes a dielectric ceramic layer doped with a material selected from the group consisting of semiconductive oxides, ferrous oxide ($Fe_2O_3$), tin oxide ($SnO_2$), and cobalt oxide ($CoO_2$).

8. The electron gun of claim 5 wherein said one of said layers forming said resistance comprises at least one layer of dielectric ceramic having a resistance material on at least one surface thereof.

9. The electron gun of claim 8 wherein said resistance material includes a pattern of a high-resistivity thick-film ink.

10. The electron gun of claim 5 wherein said capacitance comprises conductive electrodes on opposing surfaces of said one other layer of dielectric ceramic.

11. The electron gun of claim 5 wherein said capacitance comprises conductive electrodes on opposing surfaces of a plurality of the layers of dielectric ceramic including said one other layer thereof.

12. The electron gun of claim 5 wherein said capacitance comprises a plurality of the layers of dielectric ceramic including said one other layer thereof interposed between first and second conductive electrodes.

13. The electron gun of claim 5 wherein said ceramic circuit is mounted to said electron gun.

14. An electron lens as for an electron gun for a cathode ray tube, wherein said electron gun produces a beam of electrons passing through said electron lens, said electron lens comprising:

a plurality of electrodes through which said electron beam passes, at least one of said electrodes being a focus electrode and at least one other of said electrodes being a dynamic focus electrode;

a source of a dynamic focusing signal coupled to said one other of said electrodes for applying dynamic focusing signal thereto;

a further electrode proximate said dynamic focus electrode;

a resistance having a first end adapted to be coupled to a source of bias potential and a second end adapted to be connected to a point of reference potential, said resistance including a tap intermediate the first and second ends thereof, said tap being connected to said further electrode;

a capacitance having a first electrode coupled to the further electrode and a second electrode adapted to be coupled to said point of reference potential.

15. The electron lens of claim 14 in combination with a tube neck of a dielectric material in which said electron gun resides, wherein said capacitance comprises a first electrode on an interior surface of said tube neck and a second electrode on an exterior surface of said tube neck.

16. The electron lens of claim 14 wherein said resistance comprises a pattern of high resistivity material on a single layer fired dielectric ceramic substrate.

17. The electron lens of claim 14 wherein said resistance comprises a fired laminate of a plurality of layers of a dielectric ceramic.

18. The electron lens of claim 17 wherein said resistance comprises a layer of one of (a) a low conductivity ceramic layer having a conductivity lower than the conductivity of an adjacent dielectric ceramic layer, and (b) at least one layer of dielectric ceramic having a high resistivity resistance material on at least one surface thereof.

19. The electron lens of claim 17 wherein said fired laminate includes a plurality of layers of dielectric ceramic interposed between at least two conductive plates forming the first and second electrodes of said capacitance.

20. An electron lens as for an electron gun for a cathode ray tube, wherein said electron gun produces a beam of electrons passing through said electron lens, said electron lens comprising:

a plurality of electrodes through which said electron beam passes, at least one of said electrodes being a focus electrode and at least one other of said electrodes being a dynamic focus electrode;

a source of a dynamic focusing signal coupled to said dynamic focus electrode for applying dynamic focusing signal thereto;

a further electrode proximate said dynamic focus electrode;

a resistance having a first end adapted to be coupled to a source of bias potential and a second end adapted to be connected to a point of reference potential, said resistance including a tap intermediate the first and second ends thereof, said tap being connected to said further electrode;

a capacitance having a first electrode coupled to the further electrode and a second electrode adapted to be coupled to said point of reference potential.

21. The electron lens of claim 20 wherein said resistance comprises a fired single layer of a dielectric ceramic having a pattern of a high resistivity resistance material on at least one surface thereof.

22. The electron lens of claim 20 in combination with a tube neck of a dielectric material in which said electron gun resides, wherein said capacitance comprises a first electrode on an interior surface of said tube neck and a second electrode on an exterior surface of said tube neck.

23. The electron lens of claim 20 wherein said resistance comprises a fired laminate of a plurality of layers of a dielectric ceramic.

24. The electron lens of claim 23 wherein said resistance comprises a layer of one of (a) a low conductivity ceramic layer having a conductivity lower than the conductivity of an adjacent dielectric ceramic layer, and (b) at least one layer of dielectric ceramic having a high resistivity resistance material on at least one surface thereof.

25. The electron lens of claim 23 wherein said fired laminate includes said capacitance which comprises at least one layer of dielectric ceramic interposed between conductive plates forming the first and second electrodes of said capacitance.

26. The electron lens of claim 25 wherein said fired laminate includes a plurality of layers of dielectric ceramic interposed between a plurality of conductive plates forming the first and second electrodes of said capacitance.

27. In combination, an electron gun and a circuit comprising:

the electron gun including a plurality of grid electrodes including at least an anode grid electrode adapted to be biased to an anode potential and a first grid electrode; and the circuit including a resistance coupled between said anode grid electrode and a point of ground potential, said resistance including a tap, wherein said tap is coupled to the first grid electrode, and a capacitance coupled between said first grid electrode and the point of ground potential.

28. The combination of an electron gun and a circuit according to claim 21 wherein said circuit includes a fired single layer of dielectric ceramic having a pattern of high resistivity material thereon forming said resistance.

29. The combination of an electron gun and a circuit according to claim 28 wherein said fired single layer of dielectric ceramic is mounted to said electron gun.

30. The combination of an electron gun and a circuit according to claim 27 further comprising a tube neck of a dielectric material in which said electron gun resides, wherein said capacitance comprises a first plate on an exterior surface of said tube neck and a second plate on an interior surface of said tube neck.

31. The combination of an electron gun and a circuit according to claim 30 wherein said second plate is coupled to said first grid electrode and said first plate is coupled to said point of ground potential.

32. In combination, an electron gun and a circuit comprising:

the electron gun including a plurality of grid electrodes including at least an anode grid electrode adapted to be biased to an anode potential and a first grid electrode; and the circuit including a resistance coupled between said anode grid electrode and a point of ground potential, said resistance including a tap, wherein said tap is coupled to the first grid electrode, and a capacitance coupled between said first grid electrode and the point of ground potential, wherein said circuit includes a fired laminate of layers of dielectric ceramic, at least one of the layers of dielectric ceramic forming said resistance and at least one other one of the layers of dielectric ceramic forming said capacitance.

33. The combination of an electron gun and a circuit according to claim 32 wherein said fired laminate of layers of dielectric ceramic is mounted to said electron gun.

* * * * *